US005962397A

United States Patent [19]

Ridyard et al.

[11] Patent Number: 5,962,397

[45] Date of Patent: Oct. 5, 1999

[54] PROCESS FOR MAKING GRANULAR DETERGENT COMPONENT

[75] Inventors: Mark William Ridyard, Heaton; David William York, Ponteland, both of United Kingdom

[73] Assignee: The Procter & Gamble Company, Cincinnati, Ohio

[21] Appl. No.: 08/983,543

[22] PCT Filed: Jul. 3, 1996

[86] PCT No.: PCT/US96/11274

§ 371 Date: Jul. 31, 1998

§ 102(e) Date: Jul. 31, 1998

[87] PCT Pub. No.: WO97/03154

PCT Pub. Date: Jan. 30, 1997

[30] Foreign Application Priority Data

Jul. 10, 1995 [EP] European Pat. Off. ..... 95304794

[51] Int. Cl.[6] ..... C11D 11/00; C11D 1/62

[52] U.S. Cl. ..... 510/443; 510/444; 510/446; 510/452; 510/477; 510/504; 510/507; 510/509; 510/511

[58] Field of Search ..... 510/443, 444, 510/446, 452, 504, 477, 507, 509, 511

[56] References Cited

U.S. PATENT DOCUMENTS

| | | | |
|---|---|---|---|
| 4,203,851 | 5/1980 | Ramachandran | 252/8.6 |
| 4,228,044 | 10/1980 | Cambre | 252/547 |
| 4,321,157 | 3/1982 | Harris et al. | 252/174.25 |
| 4,715,979 | 12/1987 | Moore et al. | 252/91 |
| 5,259,964 | 11/1993 | Chavez et al. | 252/8.6 |
| 5,338,476 | 8/1994 | Pancheri et al. | 510/352 |

FOREIGN PATENT DOCUMENTS 0520582 12/1992 European Pat. Off. .

*Primary Examiner*—Yogendra Gupta
*Assistant Examiner*—Lorna M. Douyon
*Attorney, Agent, or Firm*—Jacobus C. Rasser; Brian M. Bolam; D. Mitchell Goodrich

[57] ABSTRACT

Disclosed are granular detergent components and processes for making these components. The processes comprise the steps of: i) forming the granular detergent component by drying an aqueous solution, the aqueous solution comprising at least 50% of a cationic surfactant, to form a powder; and then ii) densifying the powder in the presence of a detergent powder selected from the group consisting of aluminosilicate, carbonate, bicarbonate, silicate, sulphate, citrate, clay and mixtures thereof and an acid selected from the group consisting of citric, sulphuric, hydrochloric, polycarboxylic acids and mixtures thereof. This granular detergent component consists essentially of the cationic surfactant, the acid and the particulate builder and the granular detergent component has a reserve acidity of at least 1.0 g HCl/100 g. Also disclosed is a granular detergent component having a bulk density of at least about 500 g/l comprising at least 42% by weight of cationic surfactant, from 1% to 60% by weight of an acid, and optionally, up to 79% by weight of a detergent powder selected from the group consisting of citric, sulphuric, hydrochloric, polycarboxylic acids and mixtures thereof wherein the granular detergent component has a reserve acidity of at least 1.0 g HCl/100 g.

5 Claims, No Drawings

PROCESS FOR MAKING GRANULAR DETERGENT COMPONENT

The present invention concerns a process for the preparation of a granular detergent component and also concerns granular detergent components comprising cationic surfactant, in particular hydrolysable cationic surfactants such as choline ester.

It is known to prepare detergent powders by spray-drying cationic surfactants optionally together with other surfactants and builders.

U.S. Pat. No. 4,347,168, issued on Aug. 31st, 1982 discloses spray-drying of alkaline crutcher mixes comprising cationic surfactants. It is stated that suitable cationic surfactants include various choline ester quaternary ammonium halides.

However, choline esters are readily hydrolised, especially in alkaline conditions. Consequently such powders are unsuitable for use by dry mixing directly into commercial granular detergent compositions which are usually alkaline.

The object of the invention is to provide a granular detergent components which comprise hydrolysable cationic surfactant and which are stable in commercial detergent compositions.

SUMMARY OF THE INVENTION

According to the invention this object is achieved by a process for the preparation of a granular detergent component comprising the steps of:

(i) drying an aqueous solution of a cationic surfactant to form a powder;

(ii) optionally, densifying the powder; wherein the granular detergent component further comprises an acid, the granular detergent component having a reserve acidity of at least 1.0 g HCl/100 g, preferably at least 3.0 g HCl/100 g, and more preferably at least 8.0 g HCl/100 g.

Preferably the powder of step (i) is formed by spray drying and comprises at least 20%, preferably at least 50% by weight of choline ester.

In a first embodiment of the invention the powder is densified by compaction in the presence of other detergent powders. In a second embodiment of the invention the powder is densified by agglomeration in the presence of other detergent powders. Preferred detergent powders are aluminosilicate, carbonate, bicarbonate, silicate, sulphate, citrate, clay or mixtures thereof. Preferred acids are citric, sulphuric, hydrochloric, polycarboxylic acid, or mixtures thereof.

The invention also relates to granular detergent components having a bulk density of at least 500 g/l comprising:

at least 20% by weight of cationic surfactant (preferably choline ester), and from 1% to 60% by weight of an acid (preferably from 10% to 60% by weight of an acid selected from the group consisting of citric, sulphuric, hydrochloric, polycarboxylic acid, or mixtures thereof), and optionally, up to 79% by weight of a detergent powder (preferably from 5% to 70% by weight of detergent powders selected from the group consisting of aluminosilicate, carbonate, bicarbonate, silicate, sulphate, citrate, clay or mixtures thereof), wherein the granular detergent component has a reserve acidity of at least 1.0 g HCl/100 g.

DETAILED DESCRIPTION OF THE INVENTION

Choline esters:

Preferred cationic surfactant are choline ester derivatives such as those having the following formula:

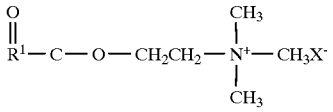

wherein R is a $C_5$ to $C_{30}$ straight chain or branched chain alkyl or alkenyl, group and X is an anion, which makes the compound at least water-dispersible, preferably selected from the group consisting of halide, methyl sulfate, sulfate, and nitrate, preferably methyl sulfate, chloride, bromide or iodide, as well as those wherein the ester linkage in the above formula is replaced with a reverse ester, amide or reverse amide linkage.

Particularly preferred examples of this type of cationic surfactant include stearoyl choline ester quaternary ammonium halides ($R^1$=$C_{17}$ alkyl), palmitoyl choline ester quatemary ammonium halides ($R^1$=$C_{15}$ alkyl), mystiroyl choline ester quatemary ammonium halides ($R^1$=$C_{13}$ alkyl), lauroyl choline ester ammonium halides ($R^1$=$C_{11}$ alkyl), as well as coconut and tallow choline ester quatemary ammonium halides ($R^1$=$C_{15}$–$C_{17}$ alkyl and $C_{19}$–$C_{13}$ alkyl, respectively).

Additional preferred cationic components of the choline ester variety are given by the structural formulas below, wherein p may be from 0 to 20.

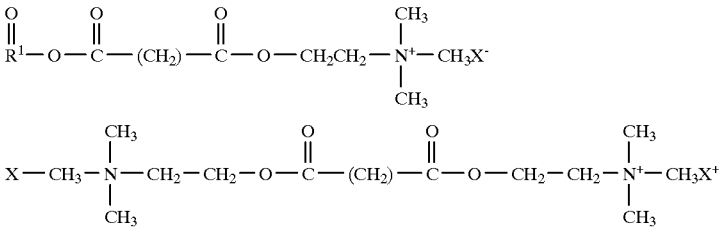

The preferred choline-derivative cationic substances, discussed above, may be prepared by the direct esterification of a fatty acid of the desired chain length with dimethylaminoethanol, in the presence of an acid catalyst. The reaction product is then quatemized with a methyl halide, forming the desired cationic material.

The choline-derived cationic materials may also be prepared by the direct esterification of a long chain fatty acid of the desired chain length together with 2-haloethanol, in the presence of an acid catalyst material. The reaction product is then used to quatemize.

Trimethylamine, forming the desired cationic component.

Other suitable choline esters for use herein have the formula:

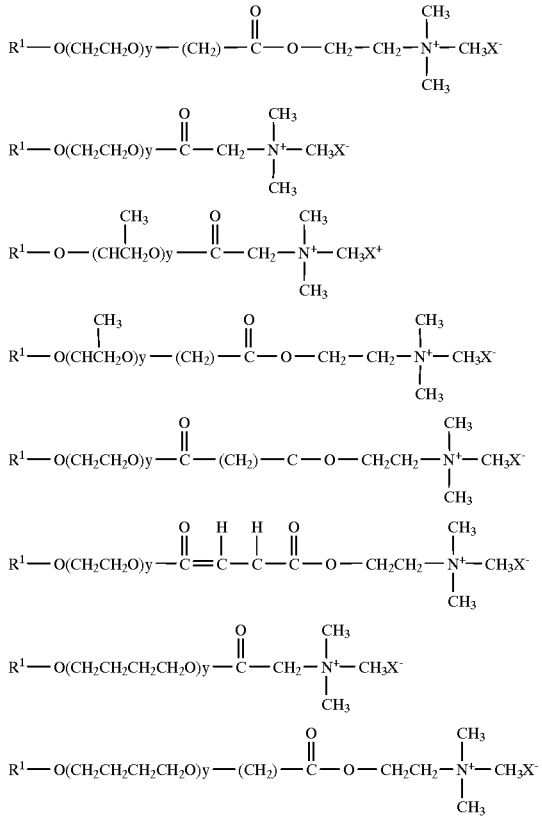

wherein t is 0 or 1, y is from 1 to 20, and R and X are as defined above.

Suitable acids include carboxylic and polycarboxylic acids such as fatty acids (C12–C18 monocarboxylic acids), mellitic acid, citric acid, succinic acid, oxydisuccinic acid, carboxymethyloxysuccinic acid ethylene diamine tetraacetic acid, nitrilotriacetic acid, as well as acrylic acid, maleic acid, fumaric acid, itaconic acid, aconitic acid, mesaconic acid, citraconic acid, methylenemalonic acid and polymers and copolymers thereof. Polymeric polycarboxylate builders are also described in U.S. Pat. No. 3 308 067, Diehl, issued Mar. 7th 1967. Further acids suitable for use in the present invention are sulphuric and hydrochloric acid.

Most preferred is citric acid

Detergent Builders/Powders.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxy-disuccinic acid, polymaleic acid, benzene 1,3,5-tricarboxylic acid, carboxymethyloxysuccinic acid, and soluble salts thereof.

Citrates can also be used, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is do-decenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Other optional additives to the granular detergent component of the present invention include hydrophobic substances such as wax and oil. Waxes are hydrocarbons which are typically derived from petroleum. Three types of wax may be distinguished (see Kirk-Othmer, Encyclopedia of Chemical Technology, 3rd Edition, Wiley, Vol. 24, pages 473 and 474): paraffin wax, microcrystalline wax and semicrystalline wax.

Paraffin wax consists principally of normal alkanes. It is composed of 40–90% normal paraffins and the remainder is C18–C36 isoalkanes and cycloalkanes. The melting point of the wax determines the actual grade and it varies between about 46° C. and 71° C. Average molecular weight is between about 350 and 420. A suitable paraffin wax for use in the present invention is BDH Pastillated Paraffin Wax, having a melting point of 51–55° C.

Semicrystalline and microcrystalline waxes contain substantial proportions of hydrocarbons other than normal alkanes. Microcrystalline waxes typically have a melting point between 60° C. and 93° C. Average molecular weight is between about 600 and 800.

A particularly preferred microcrystalline wax for use in the present invention is MMP®, supplied by Shell.

Other waxes suitable for use in the present invention are:

Beeswax;

Vegetable Wax, including Candelilla; Carnal; Japan Wax; Ouricury Wax; Douglas-Fir Bark Wax; Rice Bran Wax; Jojoba; Castor Wax; Bayberry Wax;

Mineral Wax, including Montan Wax and Peat Waxes;

Synthetic Wax, including Polyethylene Waxes; Fischer-Tropsch Waxes (polymethylene) (45–106° C.); Chemically Modified Hydrocarbon Waxes (86–125° C.) and Substituted Amide Waxes (very high melting point ca 140° C.)

The amount of wax and/or oil used in the granular detergent component should be from 0.005% to 20% by weight, preferably from 0.5% to 10% by weight and most preferably from 1% to 5% by weight of the granular detergent component.

The process of drying as referred to herein means any process step in which water is removed. Suitable drying processes include drum drying, vacuum drying, flaking, oven drying and spray drying. Spray drying is most preferred.

The process of densification as referred to herein means any treatment of powder which results in an increase in bulk density of at least 100 g/l, and prefereably of at least 200 g/l. Highly preferred densification processes are agglomeration and compaction. Alternative densification processes include extruding, pressing, milling and pelletizing. Final sizing can then be achieved by grinding and screening.

Agglomeration

In a most preferred agglomeration step powdered cationic surfactant is fed into a high shear mixer, such as a Loedige CB®. At the same time detergent powder and liquid binder are fed into the mixer; the two components being intimately mixed. The acid maybe introduced into the agglomeration process as a component of the powdered cationic surfactant, as a component of the detergent powder, as a components of the liquid binder, or a combination of any or all of these. The agglomeration process is completed in a second mixer, such as a Loedige KM® into which a powdered flow aid such as zeolite A may be added. Finally the agglomerated product is preferably dried to the required finished product moisture level Compaction A highly preferred compaction process is described in detail in EP-A 0 220 024, (P&G), published on Apr. 29th 1987. In this process base granules are prepared by drying an aqueous slurry comprising, in the process of the present invention, cationic surfactant. The base granules are then mixed with detergent builder material and compacted at a pressure of preferably from 140 kPa to 2 MPa. An example of suitable compaction equipment is the chilsonator.

Test method—Reserve acidity

1. Macerate 10 grams of granular detergent composition comprising cationic surfactant.
2. Dissolve in deionised water and make up to 1000 mls using a volumetric flask.
3. Calibrate pH meter using buffers, 4.0 and 7.0.
4. Take a 50 ml aliquot of solution and note pH.
5. Titrate with 0.1 N NaOH until pH=7.
6. Note mls NaOH and apply to the following equation.

$$\text{Reserve acidity (g HCl/100 g)} = \frac{\text{mls NaOH} * \text{N} * 3.65}{\text{Sample weight in aliquot}}$$

where, N=molarity of NaOH solution, and, sample weight=0.5 g

EXAMPLES

Example 1

| | Spray-dried powder | Agglomerate |
|---|---|---|
| Choline ester | 100 | 30 |
| Zeolite A (hydrated) | — | 27 |
| Citric Acid | — | 28 |
| Polycarboxylic acid* | — | 15 |

Polycarboxylic acid in this example was a co-polymer of maleic and acrylic acid with a molecular weight of about 60 000.

The choline ester powder (100%) was prepared in lab scale drying apparatus and subsequently treated by the following agglomeration process. The powders of choline ester citric acid and zeolite are added to a Braun food mixer. The polycarboxylic acid is poured slowly onto the powder mix as the blade is turning. When all the liquid binder has been added a dusting of zeolite is added and then the agglomerates are dried in a lab scale fluid bed dryer at 80° C. to remove all the free moisture.

The resulting granular detergent component (the agglomerate) had a reserve acidity of 9.1 g HCl/100 g

Example 2

| | Spray-dried powder | Agglomerate |
|---|---|---|
| Choline ester | 60 | 30 |
| Zeolite A (hydrated) | 40 | 27 |
| Citric Acid | — | 28 |
| Polycarboxylic acid* | — | 15 |

Polycarboxylic acid in this example was a co-polymer of maleic and acrylic acid with a molecular weight of about 60 000.

The choline ester powder was prepared by spray drying and subsequently treated by the same agglomeration process as in example 1.

The resulting granular component (the agglomerate) has a reserve acidity of 9.1 g HCl100 g.

Example 3

| | Spray-dried powder | Compact |
|---|---|---|
| Choline ester | 55 | 42 |
| Zeolite A (hydrated) | 44 | 34 |
| Citric Acid | — | 24 |
| Free water | 1 | 1 |

The choline ester powder was spray-dried and subsequently treated by the following compaction process.

The powder from the spray drying process is dry mixed with powdered citric acid. The mix is then added to the die of a Ward Forsyth batch tabletting press and pressed for a few seconds at a pressure of around 2 MPa. The subsequent tablet is ground up in a coffee grinder to form granules which are then dusted with zeolite.

The resulting granular detergent component has a reserve alkalinity of 2.3 g G HCl/100 g.

Example 4

| | Aqueous soln | Oven dried powder | Compact |
|---|---|---|---|
| Choline ester | 26 | 42 | 42 |
| Zeolite A (hydrated) | — | 34 | 34 |
| Citric Acid | 15 | 24 | 24 |
| Free water | 59 | 1 | 1 |

Citric acid was added to aqueous solution of choline ester during its synthesis. Powdered zeolite was then added to the solution and this product was then dried in an oven to remove all the free water and then ground up in a Moulinex coffee grinder. This powder was then compacted in the same manner as in example 3

The resulting granular detergent component had a reserve alkalinity of 2.3 g HCl/100 g.

Example 5

| | Aqueous soln | Oven dried powder | Agglomerate |
|---|---|---|---|
| Choline ester | 26 | 36 | 30 |
| Zeolite A (hydrated) | | 30 | 27 |
| Citric Acid | 15 | 34 | 28 |
| Polycarboxylic acid* | — | — | 15 |
| Water | 59 | — | — |

Polycarboxylic acid in this example was a co-polymer of maleic and acrylic acid with a molecular weight of about 60 000.

Citric acid was added to aqueous solution of choline ester during its synthesis. Powdered zeolite and additional powdered citric acid were then added to the solution. This product was then dried in an oven to remove all the free water and then ground up in a Moulinex coffee grinder. This powder was then treated by the same agglomeration process as in example 1.

The resulting granular detergent component had a reserve alkalinity of 9.1 g HCl/100 g.

What is claimed is:

1. A process for the preparation of a granular detergent component comprising the steps of:

(i) forming the granular detergent component by drying an aqueous solution, the aqueous solution comprising at least 50% of a cationic surfactant to form a powder; and (ii) densifying the powder in the presence of:

(a) a detergent powder selected from the group consisting of aluminosilicate, carbonate, bicarbonate, silicate, sulphate, citrate, clay and mixtures thereof; and (b) from 24 to 60% by weight of the granular detergent component of an acid selected from the group consisting of citric, sulphuric, hydrochloric, polycarboxylic acids and mixtures thereof;

wherein the granular detergent component consists essentially of the cationic surfactant, the acid and the detergent powder and the granular detergent component has a reserve acidity of at least 1.0 g HCl/100 g.

2. A process according to claim 1 wherein the granular detergent component has a reserve acidity of at least 3.0 g HCl/100 g.

3. A process according to claim 2 wherein the granular detergent component has a reserve acidity of at least 8.0 g HCl/100 g.

4. A process according to claim 1 wherein the powder of step (i) is formed by spray drying.

5. A process according to claim 4 wherein the spray dried powder is densified by agglomerating said spray dried powder in the presence of the detergent powder and the acid.

* * * * *